US011328843B1

(12) United States Patent
Bigbee, Jr.

(10) Patent No.: US 11,328,843 B1
(45) Date of Patent: May 10, 2022

(54) METHOD OF MANUFACTURE OF ELECTRICAL WIRE AND CABLE HAVING A REDUCED COEFFICIENT OF FRICTION AND REQUIRED PULLING FORCE

(71) Applicant: Encore Wire Corporation, McKinney, TX (US)

(72) Inventor: William T. Bigbee, Jr., Melissa, TX (US)

(73) Assignee: Encore Wire Corporation, McKinney, TX (US)

( * ) Notice: Subject to any disclaimer, the term of this patent is extended or adjusted under 35 U.S.C. 154(b) by 317 days.

(21) Appl. No.: 15/972,153

(22) Filed: May 6, 2018

Related U.S. Application Data

(62) Division of application No. 14/022,553, filed on Sep. 10, 2013, now abandoned.
(Continued)

(51) Int. Cl.
*H01B 13/14* (2006.01)

(52) U.S. Cl.
CPC ..... *H01B 13/148* (2013.01)

(58) Field of Classification Search
CPC ..... H01B 13/0165; H01B 13/016; H01B 11/1869; Y10T 29/49123; G01S 19/22;
(Continued)

(56) References Cited

U.S. PATENT DOCUMENTS 2,276,437 A 3/1942 Vaala
2,685,707 A 8/1954 Llewellyn et al.
(Continued)

FOREIGN PATENT DOCUMENTS

CA 2726607 A1 12/2009
CN 202917210 U 5/2013
(Continued)

OTHER PUBLICATIONS

American Polywater Corporation, "Laboratory Report—American Polywater Spurt Spray Lubricant Test Compared to Polywater J and NN", Aug. 9, 2005, 6 pages.
(Continued)

*Primary Examiner* — Minh N Trinh
(74) *Attorney, Agent, or Firm* — Warren Rhoades LLP

(57) ABSTRACT

A process for manufacturing finished wire and cable having reduced coefficient of friction and pulling force during installation, includes providing a payoff reel containing at least one internal conductor wire; supplying the at least one internal conductor wire from the reel to at least one extruder; providing the least one extruder, wherein the least one extruder applies an insulating material and a polymerized jacket composition over the at least one internal conductor wire, wherein the polymerized jacket composition comprises a predetermined amount by weight of nylon; a predetermined amount by weight of mineral oil in the range of 0.1% to 5% by weight; and a predetermined amount of silica in the range of 2% to 9% by weight; providing a cooling device for lowering the temperature of the extruded insulating material and the polymerized jacket composition and cooling the insulating material and the polymerized jacket composition in the cooling device; and, reeling onto a storage reel the finished, cooled, wire and cable for storage and distribution.

14 Claims, 4 Drawing Sheets

Related U.S. Application Data

(60) Provisional application No. 61/698,810, filed on Sep. 10, 2012.

(58) Field of Classification Search
CPC ..... G01S 19/47; G01S 5/0273; H04B 1/711; H04B 2201/70715
See application file for complete search history.

(56) References Cited

U.S. PATENT DOCUMENTS 2,930,838 A 3/1960 Chizallet et al.
3,064,073 A 11/1962 Downing et al.
3,108,981 A 10/1963 Clark et al.
3,191,005 A 6/1965 Cox, II
3,258,031 A 6/1966 French
3,333,037 A 7/1967 Humphrey et al.
3,378,628 A 4/1968 Garner
3,433,884 A 3/1969 Cogelia et al.
3,668,175 A 6/1972 Sattler
3,747,428 A 7/1973 Waner et al.
3,775,175 A 11/1973 Merian
3,822,875 A 7/1974 Schmedemann
3,849,221 A 11/1974 Middleton
3,852,875 A 12/1974 McAmis et al.
3,868,436 A 2/1975 Ootsuji et al.
3,877,142 A 4/1975 Hamano et al.
3,885,286 A 5/1975 Hill
3,936,572 A 2/1976 MacKenzie, Jr. et al.
4,002,797 A 1/1977 Hacker et al.
4,043,851 A 8/1977 Holladay et al.
4,057,956 A 11/1977 Tolle
4,099,425 A 7/1978 Moore
4,100,245 A 7/1978 Horikawa et al.
4,137,623 A 2/1979 Taylor
4,273,806 A 6/1981 Stechler
4,273,829 A 6/1981 Perreault
4,274,509 A 6/1981 Thomson et al.
4,275,096 A 6/1981 Taylor
4,299,256 A 11/1981 Bacehowski et al.
4,356,139 A 10/1982 Rowland et al.
4,360,492 A 11/1982 Rowland et al.
4,414,917 A 11/1983 Bentley et al.
4,416,380 A 11/1983 Flum
4,447,569 A 5/1984 Brecker et al.
4,449,290 A 5/1984 Saunders et al.
4,454,949 A 6/1984 Flum
4,461,712 A 7/1984 Jonnes
4,475,629 A 10/1984 Jonnes
4,522,733 A 6/1985 Jonnes
4,537,929 A * 8/1985 Nangrani ..... C08K 7/14 524/504
4,547,246 A 10/1985 Viriyayuthakorn et al.
4,565,725 A 1/1986 Spamer et al.
4,568,420 A 2/1986 Nonni
4,569,420 A 2/1986 Pickett et al.
4,605,818 A 8/1986 Arroyo et al.
4,650,073 A 3/1987 Young
4,673,516 A * 6/1987 Berry ..... C10M 145/14 508/214
4,684,214 A 8/1987 Goldmann et al.
4,693,936 A 9/1987 McGregor et al.
4,749,059 A 6/1988 Jonnes et al.
4,751,261 A 6/1988 Miyata et al.
4,761,445 A 8/1988 Chiba
4,773,954 A 9/1988 Starnes, Jr.
4,781,847 A 11/1988 Weitz
4,806,425 A 2/1989 Chu-Ba
4,868,054 A 9/1989 Kartheiser
4,902,749 A * 2/1990 Akkapeddi ..... C08F 257/02 525/279
4,937,142 A 6/1990 Ogushi et al.
4,940,504 A 7/1990 Starnes, Jr.
4,952,021 A 8/1990 Aoki et al.
4,965,249 A 10/1990 De With et al.
5,036,121 A 7/1991 Coaker et al.
5,055,522 A 10/1991 Ikeda et al.
5,063,272 A 11/1991 Sasse
5,074,640 A 12/1991 Hardin et al.
5,106,701 A 4/1992 Kurosaka et al.
5,130,184 A * 7/1992 Ellis ..... C04B 28/30 106/18.12
5,156,715 A 10/1992 Starnes, Jr.
5,182,784 A 1/1993 Hager et al.
5,190,679 A 3/1993 McDonald
5,213,644 A 5/1993 Phillips et al.
5,217,795 A 6/1993 Sasse et al.
5,225,635 A 7/1993 Wake et al.
5,227,080 A 7/1993 Berry
5,252,676 A 10/1993 Suyama et al.
5,324,588 A 6/1994 Rinehart et al.
5,326,638 A 7/1994 Mottine, Jr. et al.
5,346,383 A 9/1994 Starnes, Jr.
5,356,710 A 10/1994 Rinehart
5,383,799 A 1/1995 Fladung
5,416,269 A 5/1995 Kemp et al.
5,451,718 A 9/1995 Dixon
5,460,885 A 10/1995 Chu-Ba
5,492,760 A 2/1996 Sarma et al.
5,505,900 A 4/1996 Suwanda et al.
5,519,172 A 5/1996 Spencer et al.
5,561,730 A 10/1996 Lochkovic et al.
5,565,242 A 10/1996 Buttrick, Jr. et al.
5,614,288 A 3/1997 Bustos
5,614,482 A 3/1997 Baker et al.
5,654,095 A 8/1997 Yin et al.
5,656,371 A 8/1997 Kawahigashi et al.
5,660,932 A 8/1997 Durston
5,707,468 A 1/1998 Arnold et al.
5,707,770 A * 1/1998 Tanikawa ..... G03G 9/09716 430/108.3
5,708,084 A 1/1998 Hauenstein et al.
5,733,823 A 3/1998 Sugioka et al.
5,735,528 A 4/1998 Olsson
5,741,858 A 4/1998 Brann et al.
5,753,861 A 5/1998 Hansen et al.
5,759,926 A 6/1998 Pike et al.
5,795,652 A 8/1998 Bell et al.
5,846,355 A 12/1998 Spencer et al.
5,852,116 A 12/1998 Cree et al.
5,856,405 A 1/1999 Hofmann
5,886,072 A 3/1999 Linsky et al.
5,912,436 A 6/1999 Sanchez et al.
5,925,601 A 7/1999 McSherry et al.
5,965,263 A 10/1999 Tatematsu et al.
5,981,008 A 11/1999 Hofmann
6,039,024 A 3/2000 Carlson et al.
6,054,224 A 4/2000 Nagai et al.
6,057,018 A 5/2000 Schmidt
6,060,162 A 5/2000 Yin et al.
6,060,638 A 5/2000 Paul et al.
6,063,496 A 5/2000 Jozokos et al.
6,064,073 A 5/2000 Hoogenraad
6,080,489 A 6/2000 Mehta
6,101,804 A 8/2000 Gentry et al.
6,106,741 A * 8/2000 Heimann ..... C09D 1/00 106/14.34
6,114,036 A 9/2000 Rinehart et al.
6,114,632 A 9/2000 Planas, Sr. et al.
6,137,058 A 10/2000 Moe et al.
6,146,699 A 11/2000 Bonicel et al.
6,157,874 A 12/2000 Cooley et al.
6,159,617 A 12/2000 Foster et al.
6,160,940 A 12/2000 Summers et al.
6,184,473 B1 2/2001 Reece et al.
6,188,026 B1 * 2/2001 Cope ..... H01B 7/1885 174/120 C
6,214,462 B1 4/2001 Andre et al.
6,222,132 B1 4/2001 Higashiura et al.
6,228,495 B1 5/2001 Lupia et al.
6,242,097 B1 6/2001 Nishiguchi et al.
6,270,849 B1 8/2001 Popoola et al.
6,281,431 B1 8/2001 Cumley
6,319,604 B1 11/2001 Xu

(56) References Cited

U.S. PATENT DOCUMENTS 6,327,841 B1 12/2001 Bertini et al.
6,329,055 B1 12/2001 Higashiura et al.
6,347,561 B2 2/2002 Uneme et al.
6,359,231 B2 3/2002 Reece et al.
6,395,989 B2 5/2002 Lecoeuvre et al.
6,416,813 B1 7/2002 Valls Prats
6,418,704 B2 7/2002 Bertini et al.
6,424,768 B1 7/2002 Booth et al.
6,430,913 B1 8/2002 Gentry et al.
6,437,249 B1 8/2002 Higashiura et al.
6,461,730 B1 10/2002 Bachmann et al.
6,474,057 B2 11/2002 Bertini et al.
6,495,756 B1 12/2002 Burke et al.
6,530,205 B1 3/2003 Gentry et al.
6,534,717 B2 3/2003 Suzuki et al.
6,565,242 B2 5/2003 Dai
6,596,945 B1 7/2003 Hughey et al.
6,598,645 B1 7/2003 Larson
6,640,533 B2 11/2003 Bertini et al.
6,646,205 B2 11/2003 Hase et al.
6,728,206 B1 4/2004 Carlson
6,734,361 B2 5/2004 Mesaki et al.
6,766,091 B2 7/2004 Beuth et al.
6,810,188 B1 10/2004 Suzuki et al.
6,850,681 B2 2/2005 Lepont et al.
6,903,264 B2 6/2005 Watanabe et al.
6,906,258 B2 6/2005 Hirai et al.
6,912,222 B1 6/2005 Wheeler et al.
6,977,280 B2 12/2005 Lee et al.
6,997,280 B2 2/2006 Minoura et al.
6,997,999 B2 2/2006 Houston et al.
6,998,536 B2 2/2006 Barusseau et al.
7,053,308 B2 5/2006 Prats
7,087,843 B2 8/2006 Ishii et al.
7,129,415 B1 10/2006 Bates et al.
7,135,524 B2 11/2006 Breitscheidel et al.
7,136,556 B2 11/2006 Brown et al.
7,144,952 B1 12/2006 Court et al.
7,158,707 B2 1/2007 Will et al.
7,208,684 B2 4/2007 Fetterolf, Sr. et al.
7,247,266 B2 7/2007 Bolcar
7,267,571 B1 * 9/2007 Twigg ..... H01R 4/2433 439/402
7,302,143 B2 11/2007 Ginocchio et al.
7,411,129 B2 8/2008 Kummer et al.
7,485,810 B2 2/2009 Bates et al.
7,490,144 B2 2/2009 Carlson et al.
7,491,889 B2 2/2009 Dinkelmeyer et al.
7,549,474 B2 6/2009 Valenziano et al.
7,555,542 B1 6/2009 Ayers et al.
7,557,301 B2 7/2009 Kummer et al.
7,642,451 B2 1/2010 Bonn
7,678,311 B2 3/2010 Bolcar
7,749,024 B2 7/2010 Chambers et al.
7,776,441 B2 8/2010 Mhetar et al.
7,934,311 B2 5/2011 Varkey
8,043,119 B2 10/2011 Kummer et al.
8,088,997 B2 1/2012 Picard et al.
8,382,518 B2 2/2013 Chambers et al.
8,616,918 B2 12/2013 Chambers et al.
8,658,576 B1 * 2/2014 Bigbee, Jr. ..... H01B 7/02 508/110
8,701,277 B2 4/2014 Kummer et al.
9,352,371 B1 * 5/2016 Bigbee ..... B29C 48/911
9,431,152 B2 * 8/2016 Sasse ..... C08K 5/54
10,943,713 B1 * 3/2021 Bigbee, Jr. ..... C08K 3/36
2002/0002221 A1 1/2002 Lee
2002/0139559 A1 10/2002 Valls Prats
2003/0195279 A1 10/2003 Shah et al.
2004/0001682 A1 1/2004 Beuth et al.
2004/0045735 A1 3/2004 Varkey et al.
2004/0254299 A1 12/2004 Lee et al.
2005/0019353 A1 1/2005 Prinz et al.
2005/0023029 A1 2/2005 Mammeri et al.
2005/0107493 A1 5/2005 Amizadeh-Asl
2005/0180725 A1 8/2005 Carlson et al.
2005/0180726 A1 8/2005 Carlson et al.
2006/0065428 A1 3/2006 Kummer et al.
2006/0065430 A1 3/2006 Kummer et al.
2006/0068085 A1 3/2006 Reece et al.
2006/0068086 A1 3/2006 Reece et al.
2006/0088657 A1 4/2006 Reece et al.
2006/0151196 A1 7/2006 Kummer et al.
2006/0157303 A1 7/2006 Reece et al.
2006/0167158 A1 7/2006 Yagi et al.
2006/0191621 A1 8/2006 Kummer et al.
2006/0249298 A1 11/2006 Reece et al.
2006/0249299 A1 11/2006 Kummer et al.
2006/0251802 A1 11/2006 Kummer et al.
2007/0098340 A1 5/2007 Lee et al.
2007/0207186 A1 * 9/2007 Scanlon ..... A61F 2/91 424/424
2008/0015122 A1 1/2008 Student et al.
2008/0066946 A1 3/2008 Kummer et al.
2008/0244925 A1 10/2008 Shin
2008/0268218 A1 10/2008 Lee
2009/0250238 A1 10/2009 Picard et al.
2009/0250239 A1 10/2009 Picard et al.
2010/0044071 A1 2/2010 Murao et al.
2010/0105583 A1 4/2010 Garmier
2010/0163273 A1 * 7/2010 Smedberg ..... H01B 13/145 174/110 SR
2010/0230134 A1 9/2010 Chambers et al.
2010/0236811 A1 9/2010 Sasse et al.
2010/0255186 A1 10/2010 Montes et al.
2010/0285968 A1 11/2010 Gregory
2011/0034357 A1 2/2011 Kawata et al.
2011/0144244 A1 * 6/2011 Lee ..... C08L 23/06 524/84
2011/0290528 A1 12/2011 Honda et al.
2012/0012362 A1 1/2012 Kim et al.
2013/0168126 A1 7/2013 Kuchta et al.
2013/0168128 A1 7/2013 Lopez-Gonzalez

FOREIGN PATENT DOCUMENTS

EP 0283132 A2 9/1988
EP 0364717 A1 4/1990
EP 0544411 A1 6/1993
EP 1524294 A1 4/2005
FR 2674364 A1 9/1992
IN 9500996 I4 3/2010
JP 61133506 A 6/1986
JP 61133507 6/1986
JP 01110013 4/1989
JP 01144504 6/1989
JP 01166410 A 6/1989
JP 01307110 12/1989
JP 05266720 10/1993
JP 06057145 3/1994
JP 9045143 A 2/1997
JP 09251811 9/1997
JP 1012051 1/1998
JP 1086207 A 4/1998
JP 2001264601 A 9/2001
JP 2002231065 8/2002
JP 2003323820 11/2003
WO 198900763 A1 1/1989
WO 1991008262 A2 6/1991
WO 1995012885 A1 5/1995
WO 2000040653 A1 7/2000
WO 2001081969 A1 11/2001
WO 2001090230 A1 11/2001
WO 2002043391 A1 5/2002
WO 2003086731 A1 10/2003
WO 2005042226 A1 5/2005
WO 2006015345 A2 2/2006
WO 2006016895 A1 2/2006
WO 2006016896 A1 2/2006
WO 2006118702 A2 11/2006
WO 2006127711 A2 11/2006
WO 2007081372 A1 7/2007
WO 2007084745 A2 7/2007
WO 2009126613 A1 10/2009

(56) References Cited

FOREIGN PATENT DOCUMENTS

| | | | |
|---|---|---|---|
| WO | 2009126619 | A1 | 10/2009 |
| WO | 2010107932 | A1 | 9/2010 |
| WO | 2010113004 | A2 | 10/2010 |

OTHER PUBLICATIONS

American Polywater Corporation, "Polywater J Specification", Aug. 2010, 4 pages.
American Polywater Corporation, "Polywater SPY Cable Lubricant—Technical Specification", May 2008, 4 pages.
American Polywater Corporation, "Polywater SPY Lubricant—Technical Report", Feb. 26, 2008, 4 pages.
Axel Plastics Research Laboratories, Inc., Product Data Sheet re "Mold Wiz. INT-40DHT" (Approx. 2001) (1 p).
CSA Standards Update Service, "Thermoplastic-Insulated Wires and Cables", UL 83, Thirteenth Edition, Nov. 15, 2003, 186 pages.
Decoste, "Friction of Vinyl Chloride Plastics", SPE Journal, vol. 25, Oct. 1969, pp. 67-71.
Domininghaus, "Les Matieres plastiques les plus usuelles," Informations Chimie No. 158, pp. 179-194, 1976.
Dow Corning article "Siloxane additive minimizes friction in fibre optic cable conduit", 2000 (2 pp) (http://www.dowcorning.com).
Dow Corning Material Safety Data Sheet re Dow Corning MB50-011 composition, Mar. 4, 2008 (1 p) (http://www.dowcorning.com).
Dow Corning Material Safety Data Sheet sheet re Dow Corning MB50-320 composition, Mar. 4, 2008 (I pp) (http://www.dowcorning.com).
Dow Corning Material Safety Data Sheet: re Dow Corning MB50-008 composition, Mar. 4, 2008 (1 pp) (http://www.dowcorning.com).
Dow Corning Product Information sheet re Dow Corning MB40-006 composition. 1997-2005(1 p) (http://www.downcorning.com).
Dow Corning Product Information sheet re Dow Corning MB50-001 composition. Jan. 15, 2001 (6 pp) (http://www.dowcorning.com).
Dow Corning Product Information sheet re Dow Corning MB50-002 composition, 1997-2014 (4 pp) (http://www.dowcorning.com).
Dow Corning Product Information sheet re Dow Corning MB50-004 composition, Jan. 15, 2001 (4 pp) (http://www.dowcorning.com).
Dow Corning Product Information sheet re Dow Corning MB50-010 composition, Jan. 16, 2001 (2pp) (http://www.dowcorning.com).
Dow Corning Product Information sheet re Dow Corning MB50-321 composition, Jan. 15, 2001 (2pp) (http://www.dowcorning.com).
Dow Corning Product information sheets re Dow Corning MB50-313 composition, Nov. 5, 2001 (4 pp) (http://www.dowcorning.com).
Dow Corning Product information sheets re Dow Corning MB50-314 composition, Nov. 5, 2001 (4 pp) (http://www.dowcorning.com).
Dow Corning, "Dow Corning MB50-011 Masterbatch Material Safety Data Sheet Information", 1997-2001.
Dow Corning, "Dow Corning MB50-011 Masterbatch Product Information", Ultra-high Molecular Weight Siloxane Polymer Dispersed in Polymide 6, 1999, pp. 1-3.
European Patent Office, "Extended Search Report for Application No. 06739714.1", dated Nov. 12, 2009.
European Patent Office, Opposition to European Patent EP 1899988 and accompanying documentation, filed Oct. 22, 2013 (23 pages).
General Electric Company, Brochure entitled "GE Silicones-Fluids, Emulsions & Specialties", (2001) (19 pp).
Ideal Industries GmbH, "Yellow 77" Document, 2003, 1 page.
Trotignon et al., "Extrusion des Thermoplastiques", in "Matieres Plastiques", Editions Nathan, 1996, p. 148.
Underwriters Laboratories, Inc., Safety for Nonmetallic-Sheathed Cables, UL 719, 12th Edition, Feb. 9, 2006, pp. 1-42.
Wild, Frank, "The Effects of Silicone Polymer Additions on the Processing and Properties of an Isotactic Propylene Homopolymer", Sep. 1995, 102 pages.
Wiles, John, "Clarifying Confusing Cables", Home Power #66, Aug./Sep. 1998.

* cited by examiner

METHOD OF MANUFACTURE OF ELECTRICAL WIRE AND CABLE HAVING A REDUCED COEFFICIENT OF FRICTION AND REQUIRED PULLING FORCE

CROSS-REFERENCE TO RELATED APPLICATIONS

This application is a divisional of U.S. patent application Ser. No. 14/022,553, filed on Sep. 10, 2013, which claims the benefit of U.S. Provisional Application No. 61/698,810 filed on Sep. 10, 2012, of which the entirety of each is incorporated herein by reference.

STATEMENT REGARDING FEDERALLY SPONSORED RESEARCH OR DEVELOPMENT

Not applicable.

REFERENCE TO A COMPACT DISK APPENDIX

Not applicable.

BACKGROUND OF THE INVENTION

1. Field of the Invention

This invention relates to electrical wire and cable. More specifically, it relates to a method for manufacture of electrical wire and cable having a reduced coefficient of friction and reduced pulling force to aid in the installation of same.

2. Description of Related Art

Electrical cables used in housing and industrial projects typically include an electrical conductor surrounded by at least one additional layer. In some cases, the additional layer is an insulating layer of material used to insulate the conductor. The insulator may be made of insulating materials such as polyvinyl chloride (PVC) or polyethylene (PE). The insulating layer is then surrounded by a layer of thermoplastic material, and this outermost layer may be referred to as a "sheath" or a "jacket." The insulating and sheath layers are typically formed over the conductor core by an extrusion method. Installation of electrical cable requires the cable to be threaded or passed through sections of a building, such as walls, ceilings, ducts and other conduits. During installation of wires or cables, increased effort is required to pull the wires or cables through the conduit due to friction between the materials involved. This friction also may result in damage of the wire or cable during the installation process.

The most common electrical cable used in housing and industrial projects in the United States is called THHN ("Thermoplastic High Heat-resistant Nylon coated"). A typical THHN cable uses copper as an electrical conductor, polyvinyl chloride as the insulating material and nylon as the sheath material.

Currently, various methods are used to minimize the coefficient of friction on the surface of the wire or cable to reduce the amount of pulling force required making it easier to pull through conduit and other building structures during installation. Such methods have included manually applying a lubricant to the wire and cable at the job site just prior to installation, adding a separate lubricating layer to the wire and cable, spraying external lubricating materials onto a cooled wire and cable after formation, and incorporating the lubricant into the outer material, such as a jacket or sheath, prior to forming the sheath. However, these methods are effective to varying extents and can be time consuming, labor intensive, and can require additional material to be on the job site during cable installation, and can sometimes affect the aesthetic quality of the final wire and cable product Therefore, a need exists for a method of extruding a composition as an outer jacket onto wire and cable that reduces the coefficient of friction and effective pulling force required during installation that does not require a lubricant or hand lubricating techniques.

BRIEF SUMMARY OF THE INVENTION

The present invention provides for an extrusion system and method to manufacture electrical wire and cable having a reduced coefficient of friction wherein the method utilizes a pelletized composition for extrusion comprising polymerized silica and mineral oil with nylon to reduce the pulling force during wire and cable installation. The process for making a finished wire and cable having a reduced coefficient of friction and reduced pulling force during installation, comprises providing a payoff reel containing at least one internal conductor wire; supplying the at least one internal conductor wire from the reel to at least one extruder; providing the least one extruder, wherein the least one extruder applies an insulating material and a polymerized jacket composition over the at least one internal conductor wire, wherein the polymerized jacket composition comprises a predetermined amount by weight of nylon; a predetermined amount of commercially available mineral oil in the range of 0.1% to 5% by weight, and a predetermined amount of commercially available and synthetically produced, amorphous silica that exhibits high porosity and high purity in the range of 2% to 9% by weight, wherein the silica and mineral oil are polymerized with nylon (e.g., Nylon 6 or the like) and then pelletized for use; providing a cooling device for lowering the temperature of the extruded insulating material and the polymerized jacket composition and cooling the insulating material and the polymerized jacket composition in the cooling device; and, reeling onto a storage reel the finished, cooled, wire and cable for storage and distribution.

BRIEF DESCRIPTION OF THE SEVERAL VIEWS OF THE DRAWINGS

The foregoing summary, as well as the following detailed description, will be better understood when read in conjunction with the appended drawings. For the purpose of illustration, there is shown in the drawings certain embodiments of the present disclosure. It should be understood, however, that the invention is not limited to the precise arrangements and instrumentalities shown.

In the drawings.

DETAILED DESCRIPTION OF THE INVENTION

Figure 1:
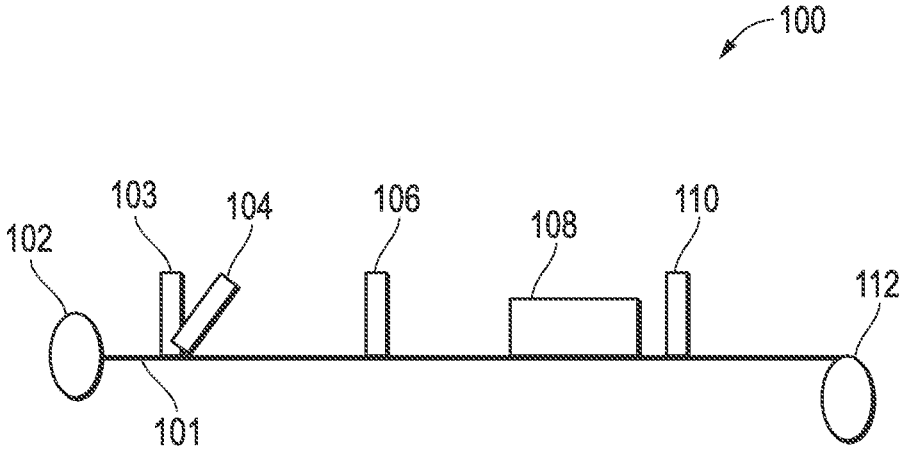
FIG. 1 depicts an overview of manufacturing process for extruding a jacket composition of polymerized silica with nylon in accordance with one embodiment of the present invention.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It should be understood that any one of the features of the invention may be used separately or in combination with other features. Other systems, methods, features, and advantages of the present invention will be or become apparent to one with skill in the art upon examination of the drawings and the detailed description. It is intended that all such additional systems, methods, features, and advantages be included within this description, be within the scope of the present invention, and be protected by the accompanying claims.

The present disclosure is described below with reference to the Figures in which various embodiments of the present invention are shown. The subject matter of the disclosure may, however, be embodied in many different forms and should not be construed as limited to the exemplary embodiments set forth herein.

The present invention provides for an extrusion method of manufacturing wire and cable having a jacket of polymerized silica and mineral oil with nylon composition to effectively reduce the required pulling force in the installation of wire and cable or other related products. The present invention utilizes commercially available mineral oil and commercially available and synthetically produced, amorphous silica that exhibits high porosity and high purity and polymerizes the silica and mineral oil with nylon (e.g., Nylon 6 or the like) which is finally pelletized for use in the manufacturing of wire and cable. The mineral oil acts as a processing lubricant and is exhausted during the extrusion process. In one disclosed embodiment, no mineral oil is detected in the formed electrical wire and/or cable product after the formation and cooling of the jacket. In another disclosed embodiment, trace amounts of mineral oil are detected in the formed electrical wire and/or cable product after the formation and cooling of the jacket, however, the trace amount of mineral oil does not contribute to the reduction of pulling force during the installation of the electrical wire and/or cable. It is understood by those skilled in the art that a wide variety of processing lubricants can be utilized in the present invention. Such processing lubricants, and their use in assisting with the flow of material through the extruder during extrusion, are well known to those skilled in the art. The resulting extruded, finished wire and/or cable product with a polymerized silica and mineral oil with nylon jacket provides a reduced coefficient of friction such that the required pulling force to install and pull the wire/cable through sections of building walls, ceilings, ducts, and other conduits is also advantageously reduced.

A method of extruding a pre-pelletized composition of polymerized silica and mineral oil, as described above, with nylon into an outer jacket or sheath for electrical wire and cable is disclosed. The method utilizes a predetermined amount of nylon, mineral oil and silica in a polymerized composition in pelletized form, wherein the amount of silica utilized in the composition ranges from about 2% to 9% by weight and the amount of mineral oil utilized in the composition ranges from 0.1% to 5%. In one disclosed embodiment, the amount of silica utilized in the composition is about 6% and the amount of mineral oil utilized in the composition ranges from about 2.5% to 3%.

Pull tests conducted resulted in a sufficient and measured reduction in the pulling force to comply with or exceed industry expectations. A first set of pull tests were conducted utilizing a 350 KCMIL finished wire product 300 manufactured by the present process and having a minimum of 3% silica polymerized with nylon in an outer jacket or sheath 306 which surrounds at least one internal conductor 302 and an insulating layer 304. For example, Table 1 shows an example of the pulling forces exerted over certain time intervals for 350 KCMIL electrical wire. The testing of the cable was performed by pulling three conductors of 350 KCMIL AWG THHN through a 3 inch dry metal conduit configuration 400 using a 120 VAC, 15 amp, 60 Hz 6800 Greenlee Ultra Tugger apparatus rated at 8000 lbs. maximum and 6500 lbs. continuous duty. The wires were pulled through a conduit system with four 90 degree turns. Interval readings from the Greenlee Tugger apparatus show the force required to pull the cable and were recorded every 2 minutes. After approximately 15 minutes, the pull was concluded and individual readings were averaged to produce a final average pulling force required to move the cable. The conduit configuration used in the pull test example was set up as follows:

1.) 4 feet, 6.5 inches vertical run that includes first 90 degree turn.
2.) 67 feet, 2.5 inches horizontal run.
3.) 2 feet, 10 inches horizontal run including the second 90 degree turn.
4.) 19 feet, 3.75 inches horizontal run.
5.) 2 feet, 10 inches horizontal run including the third 90 degree turn.
6.) 67 feet, 2.5 inches horizontal run.
7.) 2 feet, 10 inches vertical drop with fourth and final 90 degree turn.

TABLE 1

| Time of pull in minutes | Pulling Force |
|---|---|
| 2 | 1100 lbs |
| 4 | 1000 lbs |
| 6 | 1000 lbs |
| 8 | 1000 lbs |
| 10 | 1100 lbs |
| 12 | 1200 lbs |
| 15 | 1500 lbs |
| | Avg. 1128.5 lbs |

Figure 3:
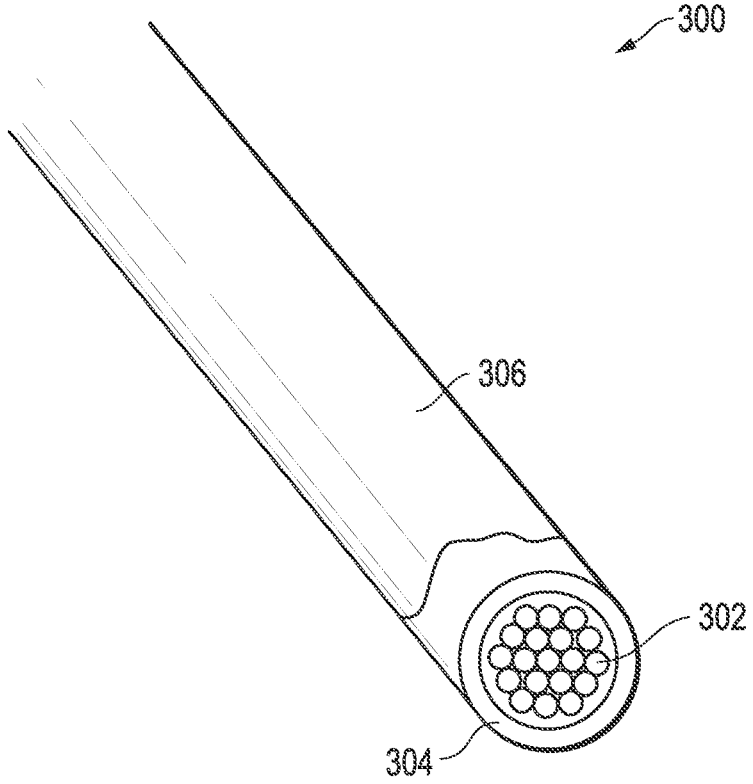
FIG. 3 is an exemplary embodiment of a wire manufactured according to the present invention.
Figure 4:
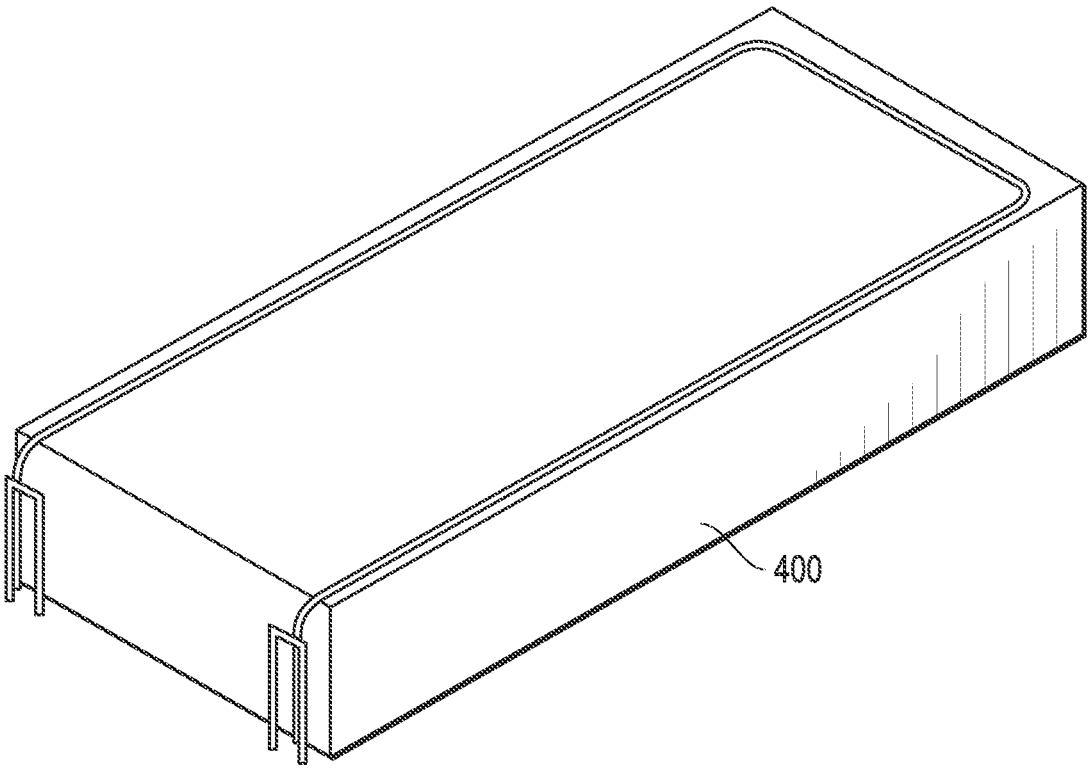
FIG. 4 is a diagram illustrating the pull test apparatus designed to measure the pulling force necessary to install an exemplary embodiment of a wire manufactured according to the present invention.

A second set of pull tests were conducted which also resulted in a sufficient and measured reduction in the pulling force to comply with or exceed industry expectations. This second set of pull tests were conducted utilizing a 500 KCMIL finished wire product manufactured by the present invention and having a minimum of 3% silica and 2.5% mineral oil polymerized with nylon in an outer jacket or sheath. FIG. 3 depicts an exemplary THHN wire 300 manufactured according to the present invention. The wire 300 has an outer diameter of 0.754" and consisted of three components. The first component is the stranded copper conductor at the core of the cable 302. The second component is PVC insulation 304 with an average thickness of 0.065". The final component is the outer layer 306 of Nylon/silica/mineral oil blend which has a thickness of 0.011". FIG. 4 depicts a diagram illustrating the pull test apparatus 400 designed to measure the pulling force necessary to install an exemplary embodiment of a wire manufactured according to the present invention. In one disclosed embodiment, the pull test apparatus 400 is seventy (70) feet long, thirty (30) feet wide, and twelve (12) feet tall, however, a variety of sizes may be implemented to measure the pulling force necessary to install an exemplary embodiment of a wire manufactured according to the present invention. Three lengths of the cable 300 in parallel were pulled through a conduit running across the side and top of a building as shown in FIG. 4. Six parallel conduit assemblies follow the illustrated path: 2×3" nominal diameter PVC; 2×3" nominal diameter steel; and 2×2" nominal diameter steel. The wire 300 is pulled through the conduit with the Greenlee 6800 Ultra Tugger discussed herein with regard to the first set of pull tests. The tugger rope passes through a series of three pulleys. The middle pulley is mounted on a load cell to measure the amount of force on the rope. The force on the load cell is directly proportional to the tension on the rope. The force is recorded every second. The test was repeated using a cable with a plain Nylon 6 jacket instead of the nylon/silica/mineral oil blend. The results of the pull test are shown in Table 2.

TABLE 2

| Time of pull in minutes | Pulling Force Nylon 6 | Pulling Force nylon/silica/mineral oil |
|---|---|---|
| 1 | 581 lbs | 376 lbs |
| 2 | 678 lbs | 413 lbs |
| 3 | 747 lbs | 390 lbs |
| 4 | 698 lbs | 436 lbs |
| 5 | 770 lbs | 410 lbs |
| 6 | 684 lbs | 430 lbs |
| 7 | 755 lbs | 4161bs |
| 8 | 684 lbs | 416 lbs |
| 9 | 732 lbs | 393 lbs |
| 10 | 624 lbs | 419 lbs |
| | Avg. 695 lbs | Avg. 410 lbs |

Referring to FIG. 1, a diagram is depicted that illustrates a system and method of manufacturing for extruding the pre-pelletized composition of polymerized nylon with silica and mineral oil in accordance with one embodiment of the present invention. In this embodiment, a standard payoff reel 102 to supply an internal conductor(s) 101, such as a copper or aluminum wire is provided in system 100. The standard payoff reel 102 supplies the internal conductor(s) 101 to a first extruder 103 to apply at least an insulating material and an outer jacket over the internal conductor(s) 101. First extruder 103 may be a single extruder head, a plurality of extruders, a cross head, a co-extrusion head or any combination thereof. The insulating material may be thermoset, thermoplastic, elastomeric, polymeric dielectric, polyvinylchloride (PVC), or a semiconductor compound or any combination thereof. The outer jacket may be an additional insulating material or a composition of polymerized nylon with silica and mineral oil.

A second extruder 104 can also be utilized in system 100 to apply, as necessary or desired, an additional layer of insulating material over the internal conductor(s) 101 that may similarly comprise a thermoset, thermoplastic, elastomeric, polymeric dielectric, polyvinylchloride (PVC) or a semiconductor compound or any combination thereof. The second extruder 104 can also function in the system 100 to apply a further additional layer, such as, but not limited to the pelletized composition of polymerized nylon with silica and mineral oil, over the wire or cable to form an outer jacket.

A third extruder 106 may also be provided in system 100 to apply a further additional layer of thermoplastic or thermoset material, elastomeric, polymeric dielectric, polyvinylchloride (PVC), or a semiconductor compound or any combination thereof. Alternatively, the third extruder 106 can also be used to extrude a further additional layer, such as, but not limited to the pelletized composition of polymerized nylon with silica and mineral oil over any prior extruded layers or materials. It is contemplated by the present invention that even further additional optional extruders may be provided for additional material application to the wire and cable.

After the insulating material and the outer jacket are applied, the wire or cable is supplied to a cooling device 108 for cooling the applied insulating material and the composition of polymerized nylon with silica and mineral oil over the wire or cable. In one embodiment, the cooling device 108 may be a water trough or similar device that contains a cooling material. The cooling device 108 functions to cool and lower the temperature of the insulating material over the wire or cable as it departs extruder 103 and/or second extruder 104 and/or the third extruder 106 and enters the cooling device 108 by removing latent heat caused by extrusion in extruder 104 or the second extruder 104 or the third extruder 106. The cooling of insulating material provides a more stable polymeric state for later processing. In one embodiment, the insulating material is cooled to an ambient temperature, such as a temperature of less than 85 degrees Celsius.

After the extrusion process, a motor-driven reel 112 is provided to wind up the resulting wire or cable. The resulting wire or cable is reeled by the motor-driven reel 112 and wrapped in plastic film for distribution or storage.

Figure 2:
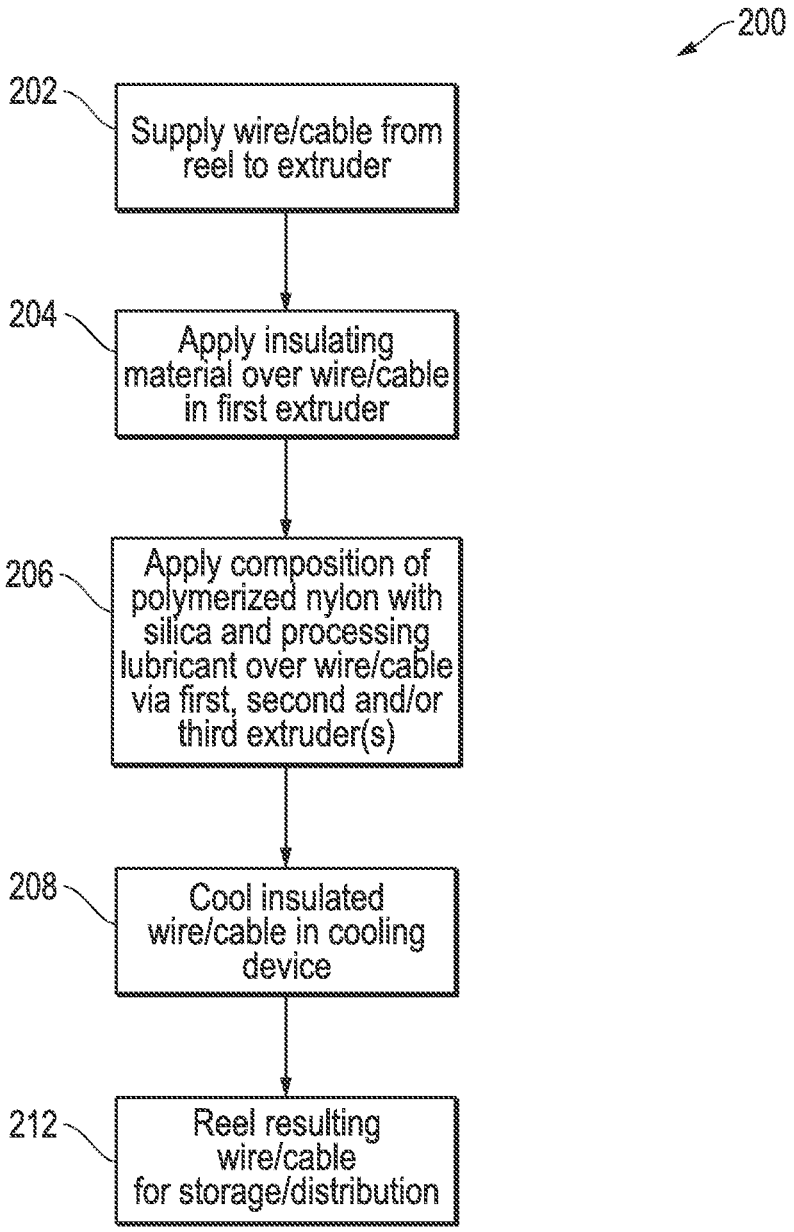
FIG. 2 is a diagram illustrating a manufacturing process for reducing the coefficient of friction in accordance with one embodiment of the present invention.

Referring to FIG. 2, a diagram illustrating a process for reducing the coefficient of friction is depicted in accordance with one embodiment of the present invention. Process 200 begins at step 202 to supply a conductor wire or cable from a reel to an extruder. Next, process 200 continues to step 204 to apply an insulating material over the internal conductor of the wire or cable. For example, insulating material such as PVC or PE may be applied over the internal conductor in extruder 104 of FIG. 1. Process 200 then continues to step 206 to apply additional material over the insulated wire or cable in an optional extruder. For example, an outer jacket composed of nylon, silica, and a processing lubricant, such as mineral oil, is applied over the insulating material. Further, additional insulating material, such as PVC or PE, may be applied over the insulated wire or cable in the first optional extruder 104 and/or the second optional 106 of FIG. 1, or any combination thereof.

Process 200 then continues to step 208 to cool the insulated wire or cable using a cooling device 108 of FIG. 1. For example, the cooling device 108 may be a water trough that cools the insulating material by removing latent heat caused by extrusion in extruder 104 or optional extruder 106. In one embodiment, the insulating material is cooled to an ambient temperature, such as a temperature of less than 85 degrees Celsius.

What is claimed is:

1. A process for making a finished wire and cable having a reduced coefficient of friction and reduced pulling force during installation, the process comprising:

providing a payoff reel containing at least one internal conductor wire;

supplying the at least one internal conductor wire from the payoff reel to an extruder;

providing the extruder, wherein the extruder applies an insulating material and a polymerized jacket composition over the at least one internal conductor wire, wherein the polymerized jacket composition comprises:

a predetermined amount by weight of nylon;

a predetermined amount by weight of a processing lubricant; and a predetermined amount of amorphous silica in a range of 2% to 9% by weight, wherein the polymerized jacket composition is provided to the extruder in pelletized form;

providing a cooling device for lowering a temperature of the extruded insulating material and the polymerized jacket composition and cooling the insulating material and the polymerized jacket composition in the cooling device; and, reeling onto a storage reel the finished wire and cable that is cooled.

2. The process of claim 1 wherein the predetermined amount by weight of the processing lubricant includes a predetermined amount by weight of mineral oil.

3. The process of claim 2 wherein the predetermined amount by weight of the mineral oil is exhausted during the extrusion of the polymerized jacket composition.

4. The process of claim 2 wherein the predetermined amount by weight of the mineral oil is nearly exhausted during the extrusion of the polymerized jacket composition.

5. The process of claim 2 wherein the predetermined amount by weight of the mineral oil includes a predetermined amount of weight of the mineral oil in a range of 0.1% to 5% by weight.

6. The process of claim 5 wherein the predetermined amount by weight of the mineral oil includes a predetermined amount of weight of the mineral oil in the range of 2.5% to 3.0% by weight.

7. The process of claim 6 wherein the predetermined amount of the amorphous silica in the range of 2% to 9% by weight includes about 6% amorphous silica by weight.

8. The process of claim 1 wherein the at least one internal conductor wire includes a copper wire.

9. The process of claim 1 wherein the at least one internal conductor wire includes an aluminum wire.

10. A process for making a finished wire and cable having a reduced coefficient of friction and reduced pulling force during installation, the process comprising:

providing a payoff reel containing at least one internal conductor wire;

supplying the at least one internal conductor wire from the payoff reel to a first extruder and a second extruder;

providing the first extruder, wherein the first extruder applies an insulating material over the at least one internal conductor wire;

providing the second extruder, wherein the second extruder applies a polymerized jacket composition over the insulating material and the at least one internal conductor wire wherein the polymerized jacket composition comprises:

a predetermined amount by weight of nylon;

a predetermined amount by weight of a processing lubricant; and a predetermined amount of amorphous silica in a range of 2% to 9% by weight wherein the polymerized jacket composition is provided to the extruder in pelletized form;

providing a cooling device for lowering a temperature of the extruded insulating material and the polymerized jacket composition and cooling the insulating material and the polymerized jacket composition in the cooling device; and, reeling onto a storage reel the finished wire and cable that is cooled.

11. The process of claim 10 wherein the predetermined amount by weight of the processing lubricant includes a predetermined amount by weight of mineral oil.

12. The process of claim 11 wherein the predetermined amount by weight of the mineral oil includes a predetermined amount of weight of the mineral oil in a range of 0.1% to 5% by weight.

13. The process of claim 10 wherein the insulating material includes a thermoplastic material.

14. The process of claim 10 wherein the insulating material includes a polyvinylchloride material.

* * * * *